US010395632B2

(12) United States Patent
Souvestre

(10) Patent No.: US 10,395,632 B2
(45) Date of Patent: Aug. 27, 2019

(54) ELECTRONIC SYSTEM COMBINABLE WITH A MUSICAL WIND INSTRUMENT IN ORDER TO PRODUCE ELECTRONIC SOUNDS AND INSTRUMENT COMPRISING SUCH A SYSTEM

(71) Applicant: COMMISSARIAT A L'ENERGIE ATOMIQUE ET AUX ENERGIES ALTERNATIVES, Paris (FR)

(72) Inventor: Florent Souvestre, Orsay (FR)

(73) Assignee: COMMISSARIAT A L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 15 days.

(21) Appl. No.: 15/567,063

(22) PCT Filed: Apr. 18, 2016

(86) PCT No.: PCT/EP2016/058568

§ 371 (c)(1),
(2) Date: Oct. 16, 2017

(87) PCT Pub. No.: WO2016/173879

PCT Pub. Date: Nov. 3, 2016

(65) Prior Publication Data

US 2018/0137848 A1 May 17, 2018

(30) Foreign Application Priority Data

Apr. 29, 2015 (FR) ..... 15 53857

(51) Int. Cl.
*G10H 3/22* (2006.01)
*G10H 3/14* (2006.01)

(52) U.S. Cl.
CPC ..... *G10H 3/22* (2013.01); *G10H 3/143* (2013.01); *G10H 3/146* (2013.01);
(Continued)

(58) Field of Classification Search
CPC ..... G10H 3/22; G10H 3/143; G10H 3/146; G10H 2220/435; G10H 2220/525;
(Continued)

(56) References Cited

U.S. PATENT DOCUMENTS 4,119,007 A * 10/1978 Criglar ..... G10H 3/143 338/36
4,527,456 A * 7/1985 Perkins ..... G10H 1/00 84/654

(Continued)

FOREIGN PATENT DOCUMENTS

EP 1 585 107 A2 2/2005
EP 2 017 823 A1 1/2009

(Continued)

*Primary Examiner* — David S Warren
*Assistant Examiner* — Christina M Schreiber
(74) *Attorney, Agent, or Firm* — Baker & Hostetler LLP

(57) ABSTRACT

An electronic system that can be combined with a wind musical instrument with lateral holes comprising a tubular body defining, on the inside, an air column, comprises at least one device for emitting elastic mechanical waves in the body of the instrument, at least one device for receiving elastic mechanical waves positioned to receive the waves emitted by at least one emission device after their propagation in the material of the body of the instrument and designed to provide at least one reception signal characteristic of the waves received and a device for detecting and locating the disturbance induced by an action of closing at least one lateral hole of the instrument, configured to detect and identify a configuration of closing of the lateral holes of the instrument from the analysis of at least one reception signal, the detection and location device positioned removably inside the air column of the instrument.

15 Claims, 13 Drawing Sheets

(52) U.S. Cl.
CPC . *G10H 2220/435* (2013.01); *G10H 2220/525* (2013.01); *G10H 2230/155* (2013.01); *G10H 2230/221* (2013.01); *G10H 2230/241* (2013.01)

(58) Field of Classification Search
CPC ..... G10H 2230/155; G10H 2230/221; G10H 2230/241
USPC ..... 84/615
See application file for complete search history.

(56) References Cited

U.S. PATENT DOCUMENTS 5,149,904 A * 9/1992 Kamiya ..... G10H 1/02 84/395
5,668,340 A * 9/1997 Hashizume ..... G10D 9/005 84/723
5,770,893 A * 6/1998 Youlton ..... F03B 13/142 290/42
7,501,570 B2 * 3/2009 Shibata ..... G10D 9/043 341/21
2005/0217464 A1 * 10/2005 Onozawa ..... G10H 1/055 84/723
2006/0065108 A1 * 3/2006 Kergomard ..... G10H 1/16 84/659
2007/0221038 A1 * 9/2007 Sawada ..... G10D 7/10 84/380 R
2007/0227343 A1 * 10/2007 Sawada ..... G10D 7/08 84/723
2007/0234887 A1 * 10/2007 Sawada ..... G10D 9/04 84/723
2009/0019999 A1 * 1/2009 Onozawa ..... G10H 1/34 84/658
2009/0020000 A1 * 1/2009 Onozawa ..... G10D 7/00 84/723
2009/0038463 A1 * 2/2009 Fujii ..... G10D 9/026 84/398
2009/0235807 A1 * 9/2009 Nagakura ..... G10G 7/02 84/454
2012/0200517 A1 * 8/2012 Nikolovski ..... G06F 3/0436 345/173
2013/0233080 A1 * 9/2013 Nikolovski ..... G01S 7/521 73/629
2018/0137848 A1 * 5/2018 Souvestre ..... G10H 3/146

FOREIGN PATENT DOCUMENTS

FR 2 948 471 A1 1/2011
GB 2 328 553 A 2/1999
KR 101 380 022 B1 4/2014
KR 101380022 B1 * 4/2014
KR 101380022 B1 * 4/2014
WO 2008/145823 A1 12/2008

* cited by examiner

ELECTRONIC SYSTEM COMBINABLE WITH A MUSICAL WIND INSTRUMENT IN ORDER TO PRODUCE ELECTRONIC SOUNDS AND INSTRUMENT COMPRISING SUCH A SYSTEM

CROSS-REFERENCE TO RELATED APPLICATIONS

This application is a National Stage of International patent application PCT/EP2016/058568, filed on Apr. 18, 2016, which claims priority to foreign French patent application No. FR 1553857, filed on Apr. 29, 2015, the disclosures of which are incorporated by reference in their entirety.

FIELD OF THE INVENTION

The invention relates to the technical field of hybrid wind musical instruments, that is to say wind instruments which can alternatively operate according to a first, acoustic mode and according to a second, digital mode. The invention applies to all types of wind musical instruments with lateral holes, including a clarinet, a saxophone, a flute, an oboe, an English horn or a bassoon, this list not being exhaustive.

BACKGROUND

The acoustic mode of operation is the native mode of operation of a wind musical instrument. In this mode, the sound is produced by vibrations of the air column of the instrument which are triggered by the blowing of the player.

A digital mode of operation consists in equipping a wind musical instrument with electronic components which make it possible to produce digital sounds obtained by a sound synthesis technique applied to one or more electrical signals produced by the components.

The digital mode of operation of a wind musical instrument in particular makes it possible to make the instrument silent by playing back the digitized sound to the player through a headset. In effect, acoustic musical practice can be a source of sound nuisance and can constrain a musician to play only during certain time periods, or even discourage him or her from practicing this instrument.

Another advantage of digital operation is the widening of the range of tones by virtue of a sound synthesis technique.

One problem to be solved in this context is how to design an electronic system that can be combined with the acoustic wind instrument which can easily be reversible for the user to be able to switch from a digital mode of operation to an acoustic mode of operation.

Another problem to be solved is how to design a system which makes it possible to perform a sound synthesis from interactions of the musician with the instrument.

A first approach for rendering an instrument silent consists in attenuating the sound produced by the instrument. Methods for that are known that are based on the use of absorbent materials of foam type or methods based on attenuation by wrapping. These methods are non-intrusive and inexpensive but they are not sufficiently effective over all of the acoustic spectrum considered. Generally, the sound produced by the wind instruments with lateral holes is more difficult to attenuate than the sound produced by other instruments, for example the instruments from the brass family.

Another approach for limiting the sound nuisances consists in using a device that replaces the acoustic operation of the instrument, in other words a totally digital instrument.

This type of instrument simultaneously makes it possible to measure blowing parameters (intensity and pinching of the lips) as well as the position of the fingers on the instrument. The keys can be static or mechanical. Coupled with a synthesizer, this type of instrument makes it possible to have a wide range of tones and proves easy to use. Its minimalist technical design makes it a product that is relatively approachable in terms of costs. On the other hand, the control of such a device is different from a clarinet or a saxophone because of the configuration and the mechanical behavior of the keys and of the mouthpiece. This instrument therefore requires a complementary and an unshared learning which is unsatisfactory when the musician wants to increase his or her competence with his or her acoustic instrument.

The European patent publications EP1585107 and EP2017823 and the American patent publication U.S. Pat. No. 7,501,570 describe hybrid wind instruments which alternatively allow acoustic or digital operation. The digitization techniques considered in these patents are based on Hall-effect sensors or on infrared detectors which have to be positioned on each key of the instrument permanently and in separately. These techniques therefore require a significant number of sensors which are not reversible and which can disturb the operation of the instrument in acoustic mode.

The present invention proposes an electronic system that can be combined with a wind musical instrument with lateral holes which is based on the detection of the state of closing of the holes of the instrument via emitters and receivers of ultrasound acoustic signals or, more generally, of elastic mechanical waves.

SUMMARY OF THE INVENTION

The system according to the invention offers the advantage of being removable to allow operation in acoustic mode and can be adapted to all types of wind instruments with lateral holes.

Moreover, the invention requires means that are less intrusive and less bulky than those proposed by the prior art techniques. In particular, the invention can operate with a single emitter and a single receiver positioned at any points of the instrument and therefore does not require as many sensors as there are lateral orifices on the instrument. The fact of not having constraints on the precise positioning of the sensors on the instrument makes it possible to envisage a system that is the least possible nuisance for the user.

The subject of the invention is an electronic system that can be combined with a wind musical instrument with lateral holes comprising a tubular body defining, on the inside, an air column, said system comprising at least one device for emitting elastic mechanical waves in the body of the instrument, at least one device for receiving elastic mechanical waves positioned to receive the waves emitted after their propagation in the material of the body of the instrument and designed to provide at least one reception signal characteristic of the elastic mechanical waves received and a device for detecting and locating the disturbance induced by an action of closing of at least one lateral hole of the instrument, configured to detect and identify a configuration of closing of the lateral holes of the instrument from the analysis of said at least one reception signal, said detection and location device being positioned removably inside the air column of the instrument.

According to a particular aspect of the invention, the electronic system according to the invention comprises a single reception device or two reception devices.

According to a particular aspect of the invention, the detection and location device is configured to determine, from the chromatic tablature of the instrument, a musical note associated with the state of closing of the lateral holes of the instrument which has been detected.

According to a particular aspect of the invention, the detection and location device is configured to:

execute a first, learning phase consisting in varying the configurations of the state of closing of the lateral holes of the instrument among all of the possible configurations and record, for each configuration, at least one reference characteristic of said at least one reception signal, execute a second, monitoring phase while a user plays said musical instrument consisting in recording, for each note played by the user, at least one current characteristic of said at least one reception signal equivalent to said reference characteristic, and comparing the current characteristic to all of the recorded reference characteristics to deduce therefrom the configuration of closing of the holes of the instrument actuated by the player.

According to a particular variant, the electronic system according to the invention comprises, for each device for emitting elastic mechanical waves and each device for receiving elastic mechanical waves, a means for removably fixing the device to the body of the wind musical instrument.

According to a particular aspect of the invention, the removable fixing means is taken from the following means: adhesive, a clamp, a clip, a magnet, a ring.

According to a particular aspect of the invention, said at least one device for emitting elastic mechanical waves and said at least one device for receiving elastic mechanical waves are positioned in a removable part of the wind musical instrument.

According to a particular variant, the electronic system according to the invention comprises a means for removably fixing said detection and location device inside the air column of the wind musical instrument.

According to a particular aspect of the invention, said detection and location device is positioned in a removable part of the wind musical instrument of which the inside is partly hollow in order to define an air column, said detection and location device being positioned inside the air column.

According to a particular aspect of the invention, the removable part of the instrument is taken from the following removable parts of the instrument: the neck, the bell, the barrel, the small barrel, the mouthpiece.

According to a particular aspect of the invention, the device for emitting elastic mechanical waves is a piezoelectric actuator and the device for receiving elastic mechanical waves after their propagation is a piezoelectric receiver.

According to a particular variant, the electronic system according to the invention also comprises a sound synthesis device connected to the detection and location device for playing back to a user the notes associated with the detected configurations of closing of the holes of the musical instrument as a function of the chromatic tablature of the musical instrument.

Another subject of the invention is a wind musical instrument with lateral holes intended to selectively produce acoustic sounds and electrical sounds, comprising a wind musical instrument with lateral holes combined with an electronic system according to the invention.

According to a particular aspect of the invention, said instrument is a saxophone or a clarinet or a flute or an oboe or a bassoon.

BRIEF DESCRIPTION OF THE DRAWINGS

Other features and advantages of the present invention will become more apparent on reading the following description in relation to the attached drawings which represent.

DETAILED DESCRIPTION

The invention is based on an inventive novel application of a method making it possible to detect and locate a disturbance of a medium through a system made up of at least one acoustic wave emitter and at least one acoustic wave receiver coupled to an electronic device which receives and analyzes the signal produced by the acoustic wave receiver to deduce therefrom the location of the disturbance.

Hereinafter in the description, the expression elastic mechanical waves will be used to more widely designate the waves compatible with the system according to the invention of which the acoustic waves form part.

An example of method for locating a disturbance of a medium from emitters and receivers of elastic mechanical waves is described in the French patent from the Applicant published under the number FR 2967788 and in the equivalent American patent application published under the number US2013233080. These documents describe a system and a method for rendering a surface touch-sensitive, for example a surface made of glass or another material, by positioning on this surface at least one acoustic wave emitter and at least one acoustic wave receiver. The waves propagated in the medium formed by the surface are received by the receiver which generates a signal characteristic of the waves received. By analyzing the received signal, it is possible to detect a disturbance of the medium created by a deformation of the surface by virtue of a contact of a finger with this surface. This method thus makes it possible to locate a contact on the surface made touch-sensitive.

The present invention uses this principle and adapts it in order to apply it to identifying the state of closing of the holes of a wind musical instrument with lateral holes.

The main elements of the method for locating a disturbance of a medium described in detail in the documents FR 2967788 and US2013233080 are first of all recalled briefly.

A person skilled in the art can refer to these documents to understand and implement the invention.

Figure 1:
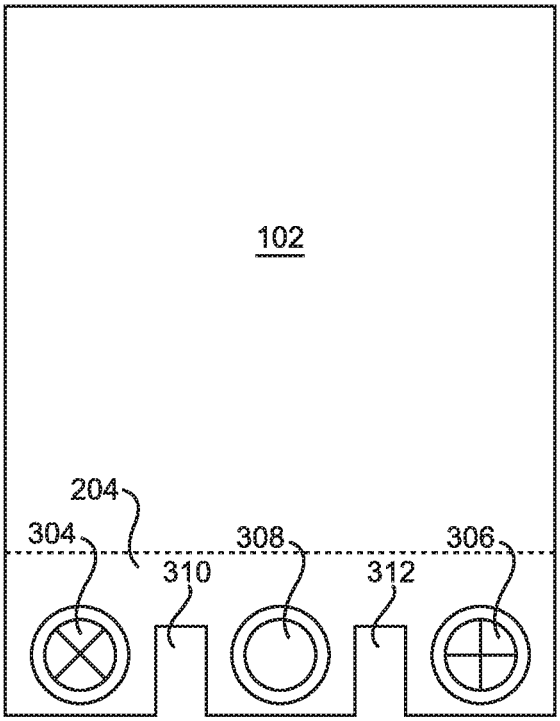
FIG. 1 Prior Art
FIG. 1, a tactile surface incorporating two acoustic wave emitters and an acoustic wave receiver according to a principle of the prior art, FIG. 2, a diagram representative of the emitters and receivers of the system of FIG. 1 coupled to an electronic device, FIG. 3, a front view of the glass plate of FIG. 1, on which reference contacts are indicated, FIG. 4, a block diagram of a learning method according to the prior art, FIG. 5, a block diagram of a monitoring method according to the prior art, FIG. 6, a profile view of a modern clarinet, FIGS. 7, 8, 9, 10, 11, 12 and 13, different configurations of closing of the lateral holes of a clarinet, FIG. 14, an example of chromatic tablature of a clarinet, FIGS. 15 and 16, an example of removable bell of a clarinet, FIG. 17, a profile view of a saxophone, FIG. 18, a diagram of an example of possible positioning of the system according to the invention on a saxophone, FIG. 19, a diagram of an example of possible configuration of the system according to the invention for a clarinet.

FIG. 1 represents a touch surface system comprising a glass plate 102, two devices 304, 306 for emitting seismic acoustic waves in the plate 102 and a device 308 for receiving seismic acoustic waves. The three devices are fixed, for example by gluing or other fixing means, in the bottom part 204 of the glass plate 102.

Preferably, the acoustic waves emitted and received are bending waves exhibiting a great wavelength compared to the thickness of the glass plate 102. These are volume waves. The energy of the acoustic field from these waves is distributed over all the thickness of the glass plate 102.

If the glass plate 102 is homogeneous and isotropic, the system is designed preferably to detect contacts on the two contact surfaces of the plate 102 independently of the contact surface where the emission 304, 306 and reception 308 devices are fixed.

Figure 2:
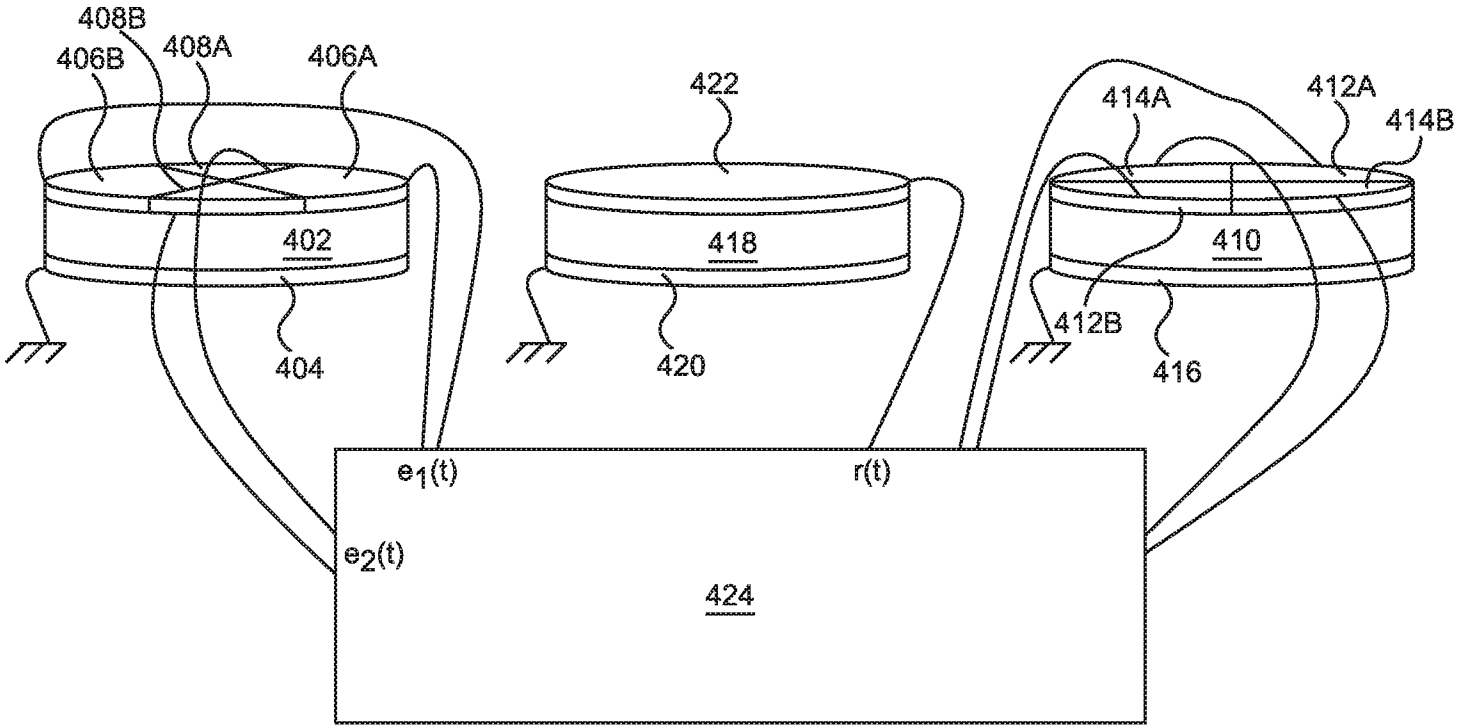
FIG. 2 Prior Art

Referring to FIG. 2, the first emission device 304 comprises a piezoelectric disk 402 (that is to say made of piezoelectric material) having a bottom face covered with a bottom electrode 404 by which the first emission device 304 is pressed against the glass plate 102. The piezoelectric disk 402 also has a top face covered by four top electrodes 406A, 406B and 408A, 408B, each covering a respective quarter of the top face. In the example described, the piezoelectric disk 402 is polarized uniformly over all its surface. The second emission device 306 is identical to the first emission device and, in the same way, comprises a piezoelectric disk 410 provided with four top electrodes 412A, 412B and 414A, 414B on its top face and a bottom electrode 416 on its bottom face. The reception device 308 comprises a piezoelectric disk 418 having a bottom face covered by a bottom electrode 420 pressed against the glass plate 102. It also comprises a top face covered by a top electrode 422. The touch surface system 100 also comprises a computing device 424 connected to the electrodes of the emission 304, 306 and reception 308 devices. More specifically, the bottom electrodes 404, 416, 420 of the two emission devices 304, 306 and of the reception device 308 are connected to an electrical ground of the computing device 424. Furthermore, the computing device 424 is designed to supply the following command signals to the first emission device: $e_1(t)$ between the two opposite electrodes 406A, 406B, and $e_2(t)$ between the other two opposite electrodes 408A, 408B. In the example described, the two opposite electrodes are polarized respectively between two mutually opposite potentials: $-e_1(t)/2$ and $+e_1(t)/2$, and the other two opposite electrodes respectively between two mutually opposite potentials: $-e_2(t)/2$ and $+e_2(t)/2$, The top electrode 422 of the reception device 308 is connected to the computing device 424 to supply a reception signal r(t) to it, from acoustic waves received by the reception device 308.

The computing device 424 is designed also to supply command signals to the second emission device 306, in the same way as for the first emission device 304, so they will not be detailed hereinbelow.

The computing device 424 is designed to detect and locate a contact on one of the contact surfaces 104A, 104B from the reception signal r(t) corresponding to the seismic acoustic waves received, that is to say to the seismic acoustic waves emitted by the first and second emission devices 304, 306 and which are propagated in the glass plate 102.

To this end, the computing device 424 is designed to implement the actions which will be detailed hereinbelow.

For example, the computing device 424 comprises a processing unit (not represented) for executing instructions of a computer program (not represented) to implement these actions.

As a variant, the computing device 424 could be replaced by an electronic device consisting solely of electronic circuits (with no computer program) to perform the same actions.

The method used to detect and locate a contact on the surface 102 will now be described, still with reference to the documents FR 2967788 and US2013233080 that the reader can consult for more details.

This method breaks down into a learning method and a monitoring method.

Figure 3:
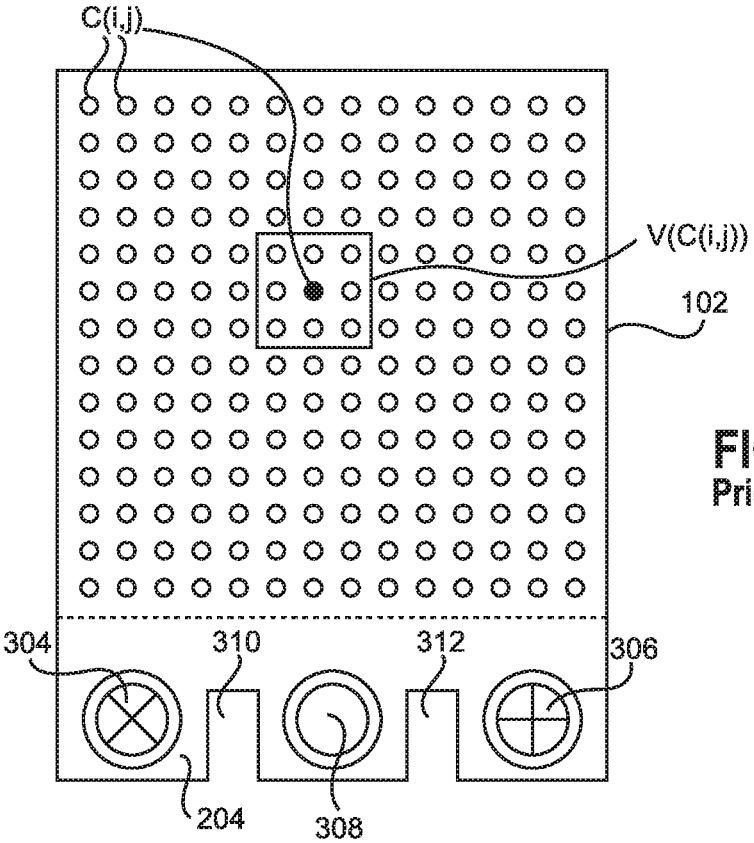
FIG. 3 Prior Art

Referring to FIG. 3, these methods use reference contacts C(i,j) whose positions on the contact surface 1046 of the glass plate 102 are known to the computing device 424. These reference contacts C(i, j) are for example distributed over a grid according to the axes A1 and A2, in which the indices (i,j) indicate their position in the grid.

These methods also use a neighborhood function V(C(i, j)) making it possible to determine the reference contacts neighboring a given reference contact C(i,j). For example, in the case where the reference contacts are distributed over a rectangular grid, the neighboring reference contacts are the eight contacts surrounding the reference contact considered on the grid ("first ring"), as is illustrated in FIG. 3.

Moreover, in these methods, only the first emission device 304 will be considered, given that the introduction of the other emission device 306 does not change the general expression of the total acoustic field in the plate. Generally, the number of emitters and receivers used can be variable and the method can operate even with a single emitter and a single receiver.

Figure 4:
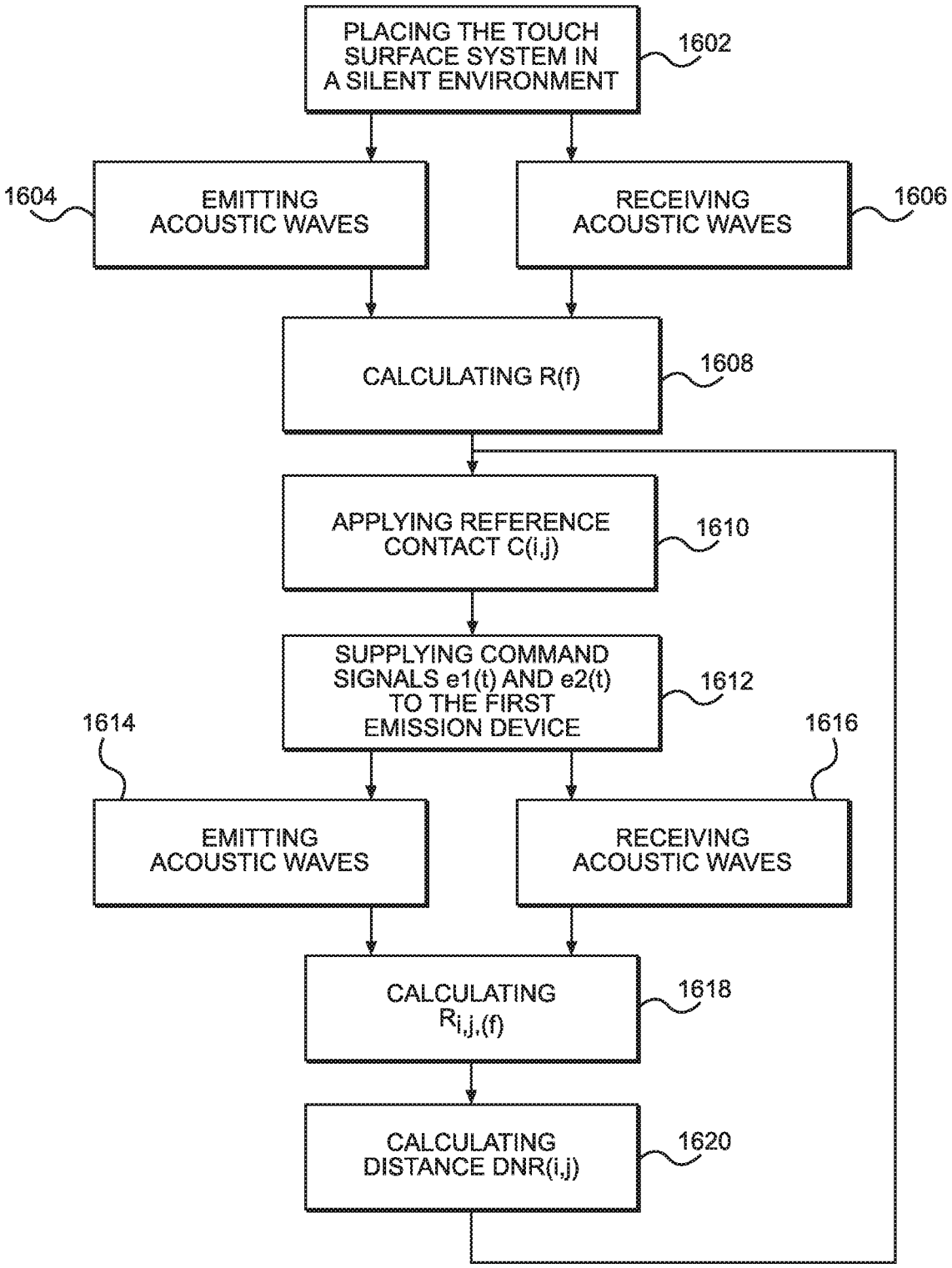
FIG. 4 Prior Art

Referring to FIG. 4, the learning method 1600 first of all comprises a step 1602 during which the touch surface system is placed in a silent environment while the glass plate 102 is left without contact.

In these conditions, during a step 1604, the computing device 424 supplies the command signals $e_1(t)$ and $e_2(t)$ as represented in FIG. 3, to the first emission device 304, and the latter emits acoustic waves in the glass plate 102.

At the same time, during a step 1606, the reception device 308 receives the acoustic waves after their propagation in the glass plate 102, and supplies to the computing device 424 a no-load reception signal, denoted r(t), corresponding to the acoustic waves received.

During a step 1608, the computing device 424 calculates the amplitude of the Fourier transform of the no-load reception signal r(t), called no-load spectral amplitude $R(f)=|fft(r(t))|$.

During a step 1610, a reference contact C(i,j) is applied to the contact surface of the glass plate 102, still in a silent environment.

During a step 1612, with the reference contact C(i,j) applied, the computing device 424 supplies the command signals $e_1(t)$ and $e_2(t)$ to the first emission device 304.

During a step 1614, the first emission device 304 emits acoustic waves corresponding to the command signals $e_1(t)$ and $e_2(t)$ in the glass plate 102, while the reception device 308, during a step 1616, receives the acoustic waves after their propagation in the glass plate 102, and supplies the corresponding reception signal, called reference reception signal $r_{i,j}(t)$, to the computing device 424.

During a step 1618, the computing device calculates the amplitude of the Fourier transform of the reference reception signal $r_{i,j}$ (t), called reference spectral amplitude $R_{i,j}(f)=|fft(r_{i,j}(t))|$.

During a step 1620, the computing device 424 calculates a distance, called reference spectral amplitude distance DNR(i,j) between the no-load amplitude and the reference amplitude. For example, the reference spectral amplitude distance DNR(i,j) is a relative normalized distance, for example equal to the norm 1 of the percentage variation of the no-load R(f)=|fft(r(t))| and reference $R_{i,j}(f)=|fft(r_{i,j}(t))|$ spectral amplitudes:

$$DNR(i,\ j) = \sum_f \left| \frac{R_{i,j}(f) - R(f)}{R(f)} \right| = \sum_f \left| \frac{R_{i,j}(f)}{R(f)} - 1 \right|$$

The method 1600 then returns to the step 1610, for another reference contact C(i,j) until all the reference contacts are scanned.

It will be able to be seen that the learning method 1600 needs to be performed only on one of the two contact surfaces of the glass plate, since two opposing contacts on either side of the glass plate 102 have the same effect on the acoustic waves propagating in the glass plate 102.

Figure 5:
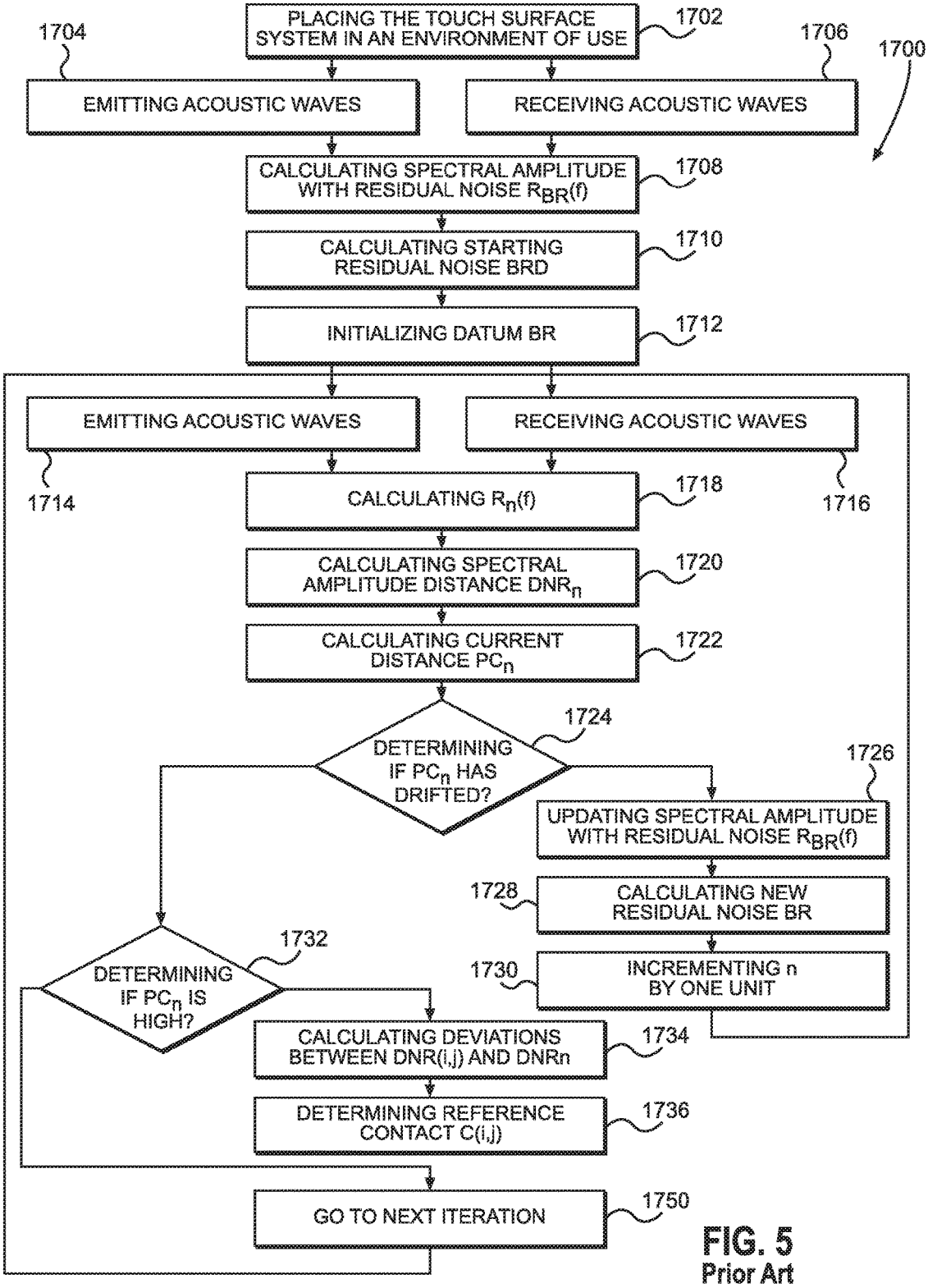
FIG. 5 Prior Art

Referring to FIG. 5, a monitoring method 1700 using the touch surface system first of all comprises initialization steps 1702 to 1712.

During a step 1702, the touch surface system is placed, without any contact applied to it, in an environment of use, the latter being able to include a residual noise making the glass plate 102 vibrate and thus producing a spurious signal in the reception signal supplied by the reception device 306. The residual noise can also originate from the processing electronics, notably from the quantization noise.

During a step 1704, the computing device 424 supplies the command signals $e_1(t)$ and $e_2(t)$ to the first emission device 304, and the emission device 304 emits the corresponding acoustic waves in the glass plate 102.

At the same time, during a step 1706, the reception device 308 receives the acoustic waves after their propagation in the glass plate 102, and supplies a reception signal, called reception signal with residual noise $r_{BR}(t)$, corresponding to the acoustic waves received, to the computing device 424.

During a step 1708, the computing device 424 calculates the amplitude of the Fourier transform of the reception signal with residual noise $r_{BR}(t)$, called spectral amplitude with residual noise $R_{BR}(f)=|fft_{BR}(r(t))|$.

During a step 1710, the computing device 424 calculates a starting residual noise BRD from the spectral amplitude with residual noise $R_{BR}(f)$ and from the no-load spectral amplitude R(f). For example, the starting residual noise BRD is the norm 1 of the percentage variation of the spectral amplitude with residual noise $R_{BR}(f)$ and the no-load spectral amplitude R(f):

$$BRD = \sum_f \left| \frac{R_{BR}(f)}{R(f)} - 1 \right|$$

During a step 1712, the computing device 424 initializes, with the value of the starting residual noise, a datum BR representing the current residual noise. Furthermore, the computing device 424 initializes an iteration counter n at the value 1.

The monitoring method 1700 then comprises the loop of monitoring steps 1714 to 1750, the current iteration of the loop of steps being the iteration n.

During a step 1714, the computing device 424 supplies the command signals $e_1(t)$ and $e_2(t)$ to the first emission device 304, and the emission device 304 emits the corresponding acoustic waves in the glass plate 102.

At the same time, during a step 1716, the reception device 308 receives the successive acoustic waves after their propagation in the glass plate 102, and supplies a reception signal called current reception signal $r_n(t)$, corresponding to the acoustic waves received, to the computing device 424.

During a step 1718, the computing device 424 calculates the amplitude of the Fourier transform of the current reception signal $r_n(t)$, called current spectral amplitude $R_n(f)=|fft(r_n(t))|$.

During a step 1720, the computing device 424 calculates a current spectral amplitude distance $DNR_n$ from the spectral amplitude with residual noise $R_{BR}$ (f) and current spectral amplitude $R_n(f)$. For example, the current spectral amplitude distance $DNR_n$ is a relative normalized distance, for example the norm 1 of the percentage variation of the spectral amplitude with residual noise $R_{BR}$ (f) and the current spectral amplitude $R_n(f)$:

$$DNR_n = \sum_f \left| \frac{R_n(f)}{R_{BR}(f)} - 1 \right|$$

During a step 1722, the computing device 424 calculates a current disturbance $PC_n$, from the current spectral amplitude distance $DNR_n$, and from the residual noise BR. For example, the current disturbance $PC_n$ is the percentage variation between the current spectral amplitude distance $DNR_n$ and the residual noise BR:

$$PC_n = \left| \frac{DNR_n}{BR} - 1 \right| \times 100$$

During a step 1724, the computing device 424 determines whether the current disturbance $PC_n$ has slightly drifted relative to the preceding iteration, which indicates a variation of the residual noise, but not a contact because the latter would create a great variation of the current disturbance $PC_n$. This small drift is for example determined if:

$$\left| \frac{PC_n}{PC_{n-1}} - 1 \right| \times 100 \leq 15\%.$$

If a small current disturbance drift $PC_n$ is determined, the steps 1726 to 1730 are implemented.

During the step 1726, the computing device 424 updates the spectral amplitude with residual noise $R_{BR}(f)$ to the value of the current spectral amplitude $R_n(f)$.

During the step 1728, the computing device 424 calculates the new residual noise BR from the updated spectral amplitude with residual noise $R_{BR}(f)$, i.e.:

$$BR = \sum_f \left| \frac{R_{BR}(f)}{R(f)} - 1 \right|$$

During the step 1730, the computing device 424 increments n by one unit and the method returns to the steps 1714 and 1716.

If no small current disturbance drift $PC_n$ is determined, during a step 1732, the computing device 424 determines whether the current disturbance $PC_n$ is high, for example above a predetermined threshold, which would indicate the occurrence of a contact. For example, a contact C is detected if $PC_n$ is greater than or equal to 100%.

If a contact C is detected, during a step 1734, the computing device 424 calculates the deviations between the reference spectral amplitude distance DNR(i,j) and the current spectral amplitude distance $DNR_n$. In the example described, these deviations are relative normalized deviations, for example expressed as percentages of the residual noise. Still in the example described, these deviations are placed in a matrix $ENRD_n(i,j)$ where each element (i,j) of the matrix corresponds to the deviation in relation to the reference contact C(i,j):

$$ENRD_n(i,\ j) = \left|\frac{DNR_n - DNR(i,\ j)}{BR} - 1\right| \times 100$$

During a step 1736, the computing device 424 determines the reference contact C(i, j) closest to the detected contact C. This is the reference contact associated with the smallest element of the matrix $ENRD_n(i, j)$ (that is to say the element indicating the smallest deviation in relation to the current spectral amplitude distance $DNR_n$). This smallest element is denoted $ES_n$=ENRD($i_n$, $j_n$) with ($i_n$, $j_n$) its position in the matrix $ENRD_n(i, j)$ and also in the grid of the reference contacts.

The computing device 424 supplies, as position of the detected contact C, the position of the closest reference contact C($i_n$, $j_n$), and the method 1700 then goes on to the step 1750.

The technique described above is modified to be applied to the determination of the state of closing of the lateral holes of a wind musical instrument. The necessary adaptations to this technique which make it possible to implement the present invention will now be described.

The general principle of the invention consists in positioning the emitters and receivers of elastic mechanical waves no longer on a flat surface but on a wind musical instrument. A wind musical instrument is a solid object that is resonant for the elastic mechanical waves. The elastic mechanical waves are propagated in the material of the body of the instrument and, when an action of the musician is performed to close certain lateral holes, this action creates a disturbance of the medium in which the waves are propagated. Each state of closing of the lateral holes associated with a different note will create a different signature on the signal produced by the receiver from the waves that it receives. The invention exploits this physical effect to detect and identify the different configurations of closing of the holes of the instrument.

The emitters and receivers of elastic mechanical waves can take the form of piezoacoustic transducers, of piezoelectric pads or of transducers made of ferroelectric ceramic.

The invention can operate with one emitter, two emitters or a number of emitters greater than two.

Similarly, the invention can operate with one receiver, two receivers or a number of receivers greater than two.

Referring to FIG. 4 and the associated description, the learning method described above is modified as follows. The touch surface system is replaced by the wind musical instrument on which are fixed at least one emitter 304, 306 and at least one receiver 308 linked to a computing device 424. The steps 1602,1604,1606 and 1608 of the learning method are applied to the musical instrument provided with the emitter and the receiver.

The steps 1610 to 1620 of the learning method are then executed by replacing the reference contact C(i,j) with a state of closing E(i) of the lateral holes of the instrument and by varying this state over all the possible states which depend on the instrument targeted and on its chromatic tablature. The different possible states of closing will be explained later in the description and in FIG. 14. More specifically, during the step 1610, a state of closing E(i) is applied to the lateral holes of the instrument, that is to say one note out of all the possible notes is played. The steps 1612,1614,1618 and 1620 are then executed in the same way as described above with reference to FIG. 4.

The monitoring method described in FIG. 5 and the associated paragraphs is also adapted as follows.

The steps 1702 to 1730 are executed in the way described above by replacing the touch surface with the musical instrument provided with the emitter and the receiver.

The step 1732 is adapted in that the aim here is no longer to detect a contact C on a surface but to detect whether the state of the instrument in relation to its non-operating state has been modified, in other words whether at least one lateral hole is closed following an action by the musician.

The step 1734 is adapted in that the deviations are calculated between the spectral amplitude distances DNR(i) corresponding to the different configurations of closing of the holes of the instrument, calculated by the learning method, and the current spectral amplitude distance.

In the step 1736, the state of closing of the holes closest to the state detected in the step 1732 is finally determined.

When a state of closing of the holes is identified, it is made to correspond to a note by virtue of the chromatic tablature of the instrument. This note is then played back digitally by virtue of a sound synthesis method.

Without departing from the scope of the invention, the method making it possible to determine the state of closing of the holes of the instrument from the signal produced by at least one receiver of elastic mechanical waves can be replaced by other methods based on the same principle such as those described in the following patent publications or patent applications: EP2150882, FR2948471, FR2948787.

A person skilled in the art will be able to refer to these different documents to implement the variants described of the method for processing the signal produced by one or more receivers of elastic mechanical waves.

To sum up, the document EP2150882 describes another method for detecting and locating a contact on a touch surface which is also based on a first learning phase during which the signatures associated with different reference contacts on the surface are recorded and a second, monitoring phase in which a contact is located by comparison of the calculated signature with the signatures recorded during the learning phase. This principle is applicable in the same way to the identification of a state of closing of the holes of a wind instrument.

Similarly, the documents FR2948471 and FR2948787 also involve a processing in two successive phases. Each of the three methods described in the prior art is based on the same principle but by proposing calculating different metrics to analyze the signal produced by the receiver or receivers and performing the comparison between signatures recorded during the learning phase and the signature calculated during the monitoring phase.

Generally, the invention implements a method for detecting and identifying the state of closing of the lateral holes of a wind musical instrument which comprises:

a first, learning phase in which a state of closing of the holes of the instrument out of all of the possible states is activated, elastic mechanical waves are made to propagate in the instrument from at least one point of emission situated on the instrument, the elastic mechanical waves are picked up at at least one reception point belonging to the instrument and certain characteristics of the signal picked up are saved in a library, this first phase being iterated over all the states of closing of the holes of the instrument corresponding to its chromatic tablature, a second, detection phase in which the player activates a state of closing of the holes of the instrument to produce a corresponding note, the elastic mechanical waves transmitted between at least one emission point and at least one reception point are once again picked up, and certain characteristics of the signal picked up are compared to the corresponding characteristics in the library to deduce therefrom the state of closing of the holes which is activated, then the corresponding note is deduced therefrom.

Depending on the method chosen, the characteristics of the signal used can be a reference spectral amplitude or a frequency vector obtained by calculation of a discrete Fourier transform on the sampled signal received or even a metric dependent on the amplitude and on the phase of the signal, for example an absorption vector or even a frequency of a fundamental mode of vibration of the surface of the body of the instrument.

The application of the invention is now described for two examples of wind instrument: a clarinet and a saxophone. These examples are in no way limiting and a person skilled in the art will without difficulty be able to extend the principles described to apply them to other wind musical instruments with lateral holes. Particularly described are the different possible arrangements of the electronic system according to the invention which is made up of at least one device for emitting elastic mechanical waves, at least one device for receiving elastic mechanical waves and a computing device configured to execute one of the different methods described above from the signals supplied by the reception device or devices.

Figure 6:
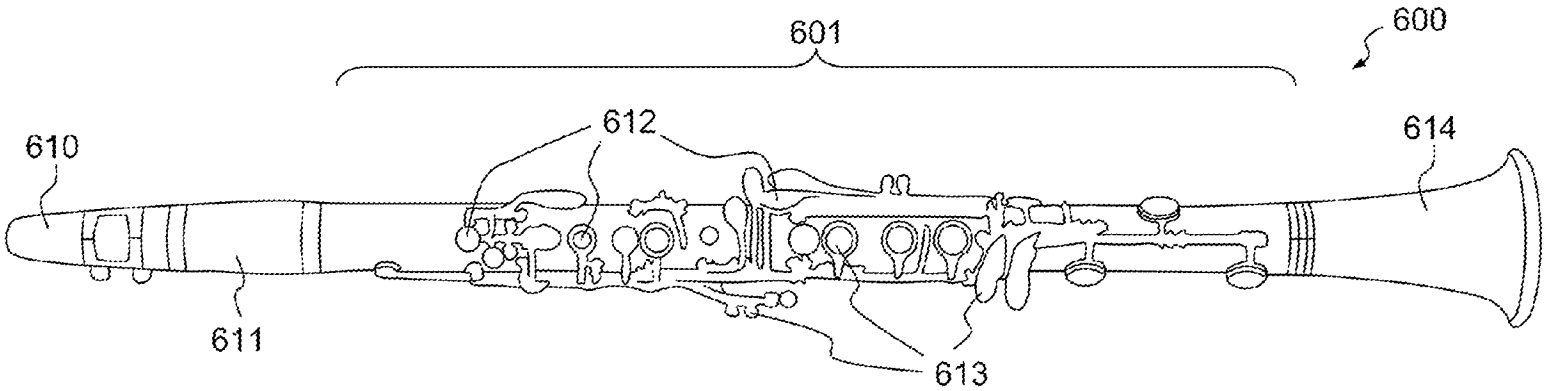

FIG. 6 represents, by profile view, a modern clarinet 600 made up of a tubular body 601 in which there are provided lateral holes, a mouthpiece 610, a barrel 611 and a bell 614. On the body, a set of keys 612, 613 are positioned which can be actuated by the left hand on one side and by the right hand on the other side. The term key is used here to designate a mechanical element which makes it possible to close a hole via the action of the musician on a ring linked to a pad. A set of keys linked to each other constitutes a linked key set. FIG. 6 shows the linked key set 612 for the left hand and the linked key set 613 for the right hand.

The lateral holes can be close directly by a finger or by a pad forming part of a key. The pad is linked to a ring positioned above another hole. Thus, the action of the finger on the ring causes another hole to be close via the pad associated with the ring.

Figure 7:
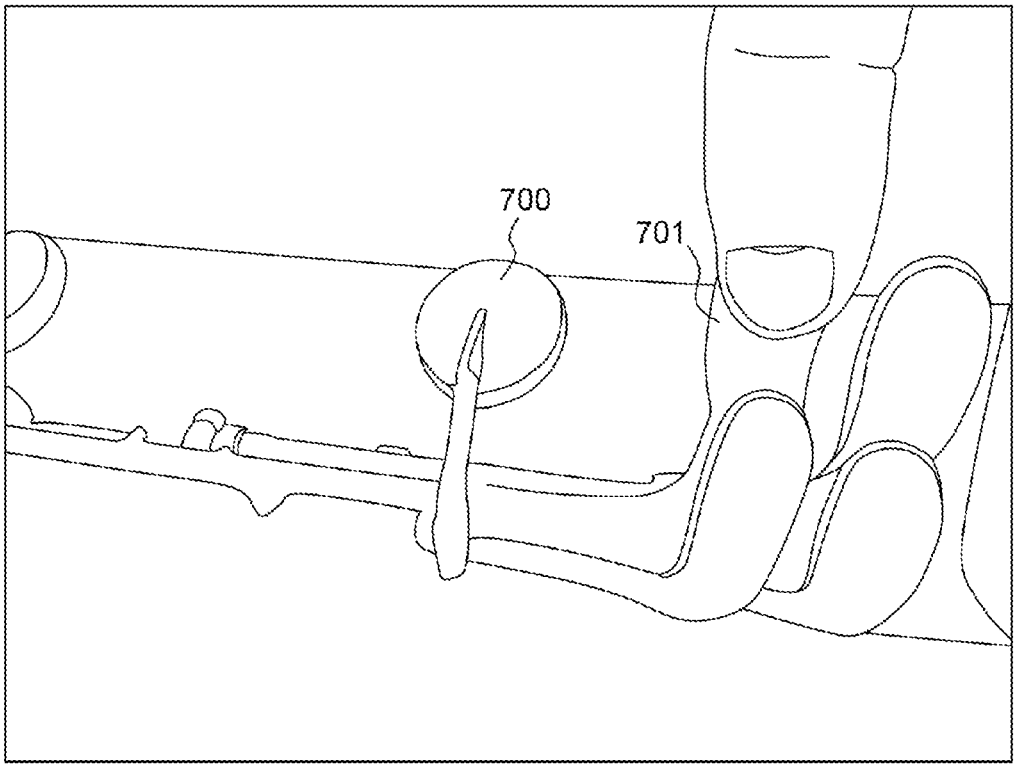

FIG. 7 represents a part of a clarinet in which a hole is closed by a pad 700 actuated by a key 701.

Figure 8:
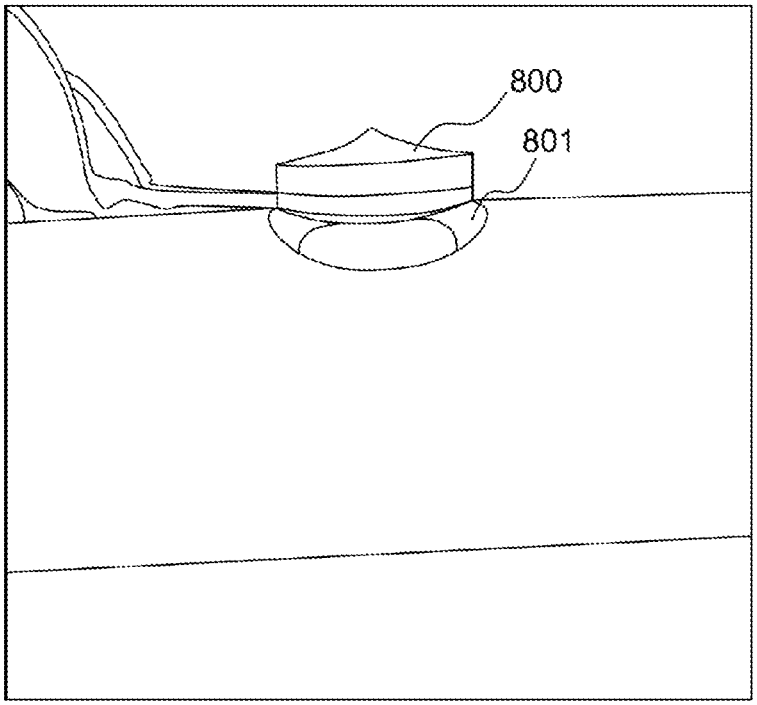
Figure 9:
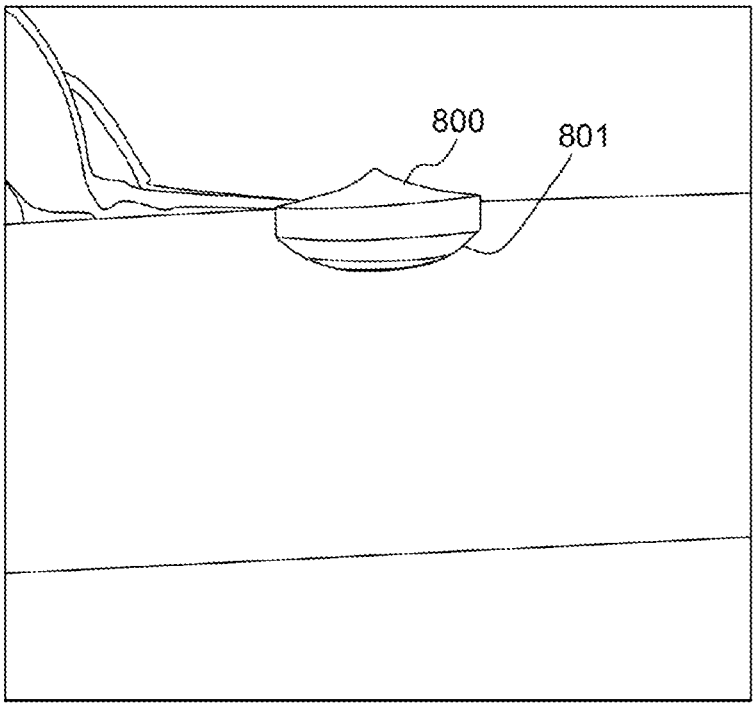

FIG. 8 represents the positioning of an open key and FIG. 9 represents the positioning of the same key closed. A pad 800 comes to be positioned over a hole 801 to close it.

Figure 10:
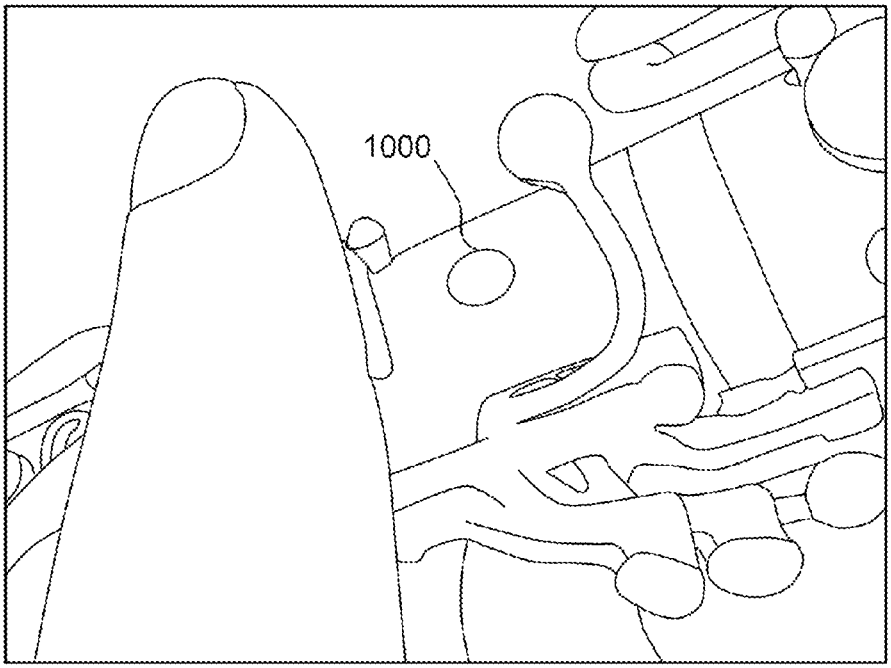
Figure 11:
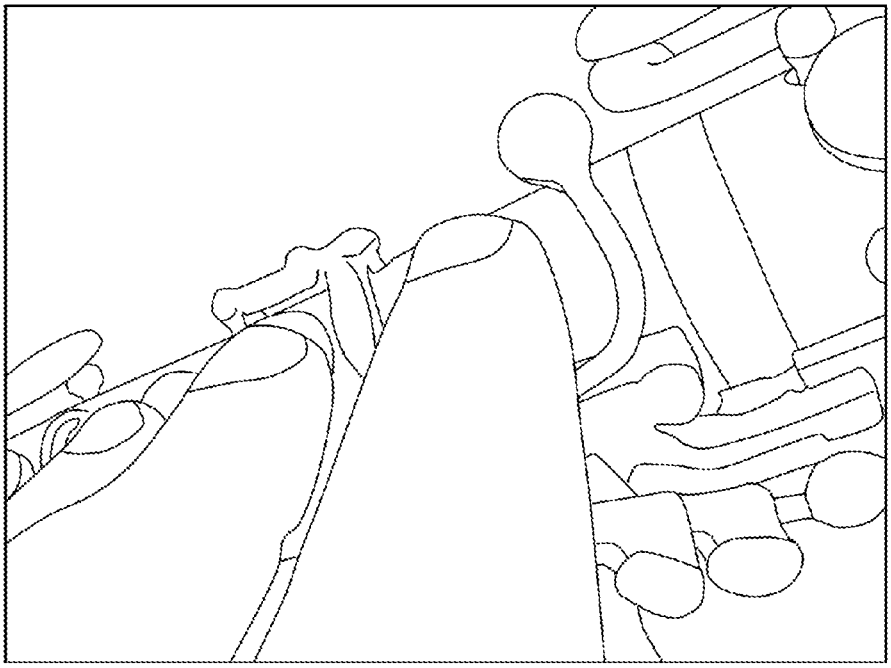

FIGS. 10 and 11 illustrate an example of closing of a hole 1000 by a finger.

Figure 12:
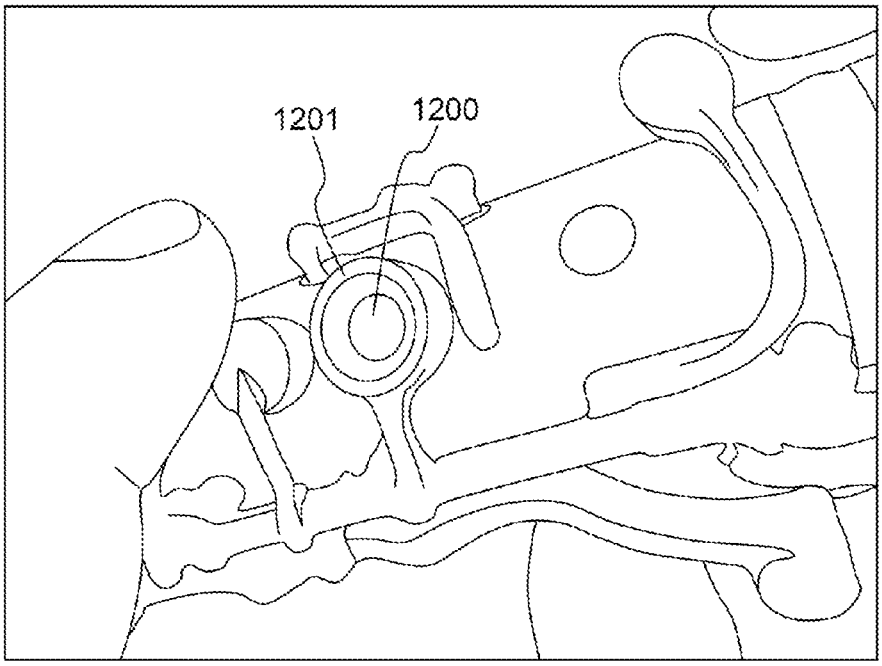
Figure 13:
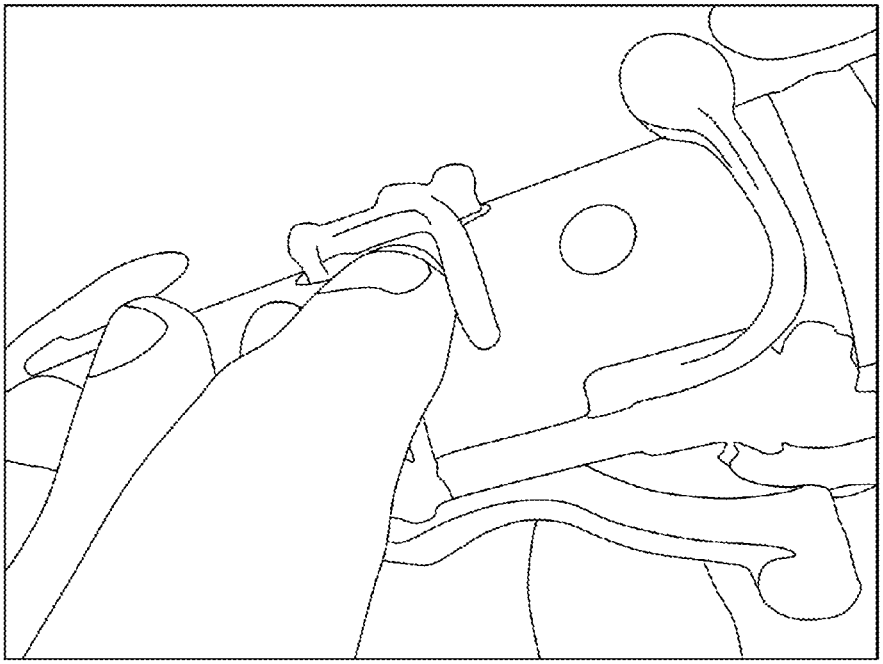

Finally, FIGS. 12 and 13 illustrate an example of closing of a hole 1200 by the action of a finger on a ring 1201 which results in the closing of other holes.

Figure 14:
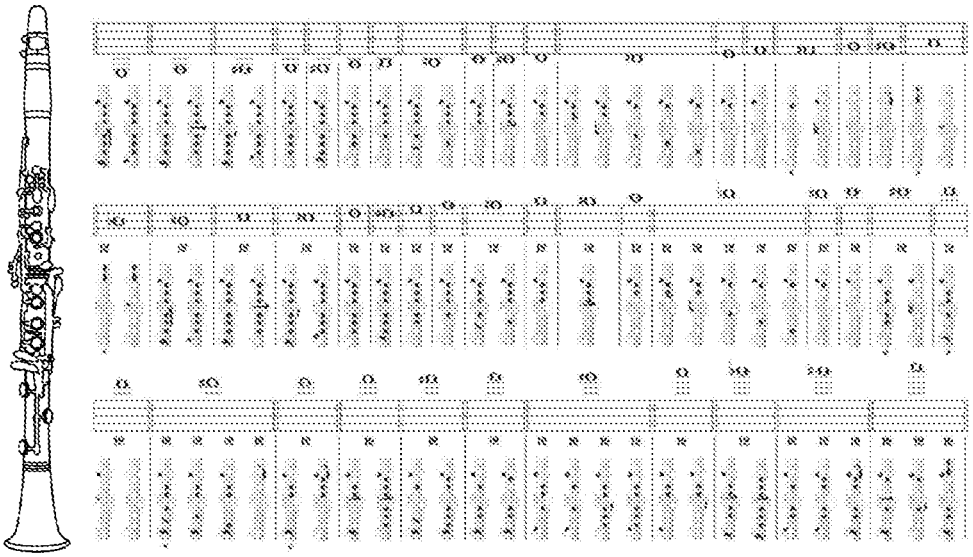

FIG. 14 shows an example of chromatic tablature of a clarinet. Each combination of closing of one or more holes corresponds to a note.

The system according to the invention must be designed so as to be removable for the instrument to be able to operate alternatively in acoustic mode and in digital mode.

For that, the emitter or emitters and the receiver or the receivers of the system according to the invention can be positioned on any part of the instrument, for example the body 601, the mouthpiece 610, the barrel 611 or the bell 614, and are fixed by a removable fixing means which can be adhesive, a clamp, a clip, a magnet, a ring, a force-fitting in the air column of the instrument or any other device making it possible to position and remove the emitters and the receivers easily.

According to a variant embodiment of the invention, the emitters and receivers can be positioned in a removable part of the instrument. This variant offers the advantage of allowing for the removal of the removable part on which the emitters and receivers are fixed to replace it by an unmodified corresponding part which makes it possible to operate the instrument in acoustic mode.

Figure 15:
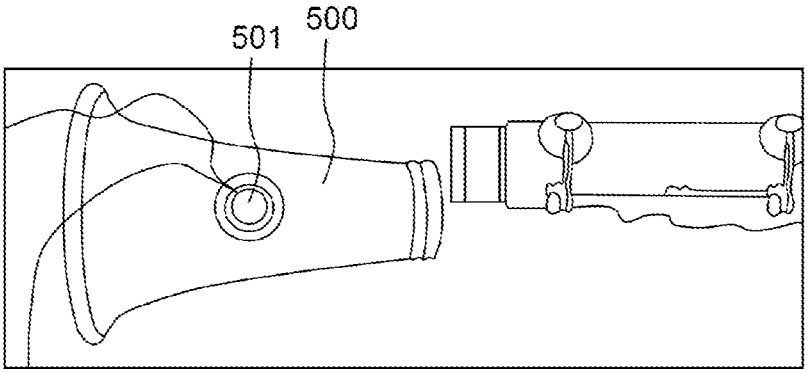
Figure 16:
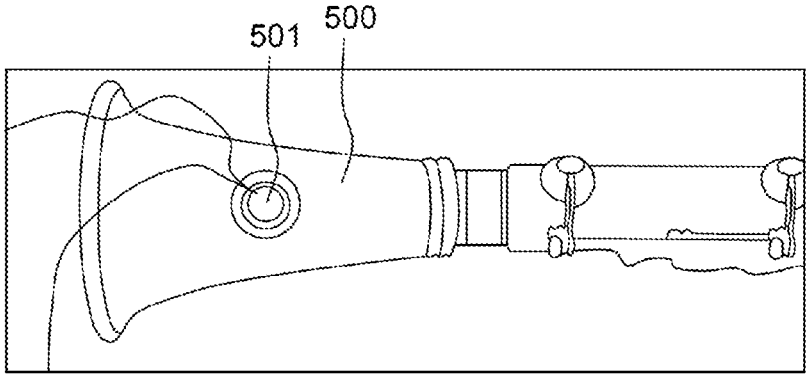

For example, in the case of the clarinet, the removable part can consist of the mouthpiece, the barrel or the bell. FIGS. 15 and 16 illustrate an example of removable bell 500 on which is fixed a receiver 501 of elastic mechanical waves. Similarly, an emitter of elastic mechanical waves (not represented) can be fixed also on the removable bell. FIG. 15 shows the bell in dismantled position. FIG. 16 shows the bell in position partially fitted in the body of the instrument.

Figure 17:
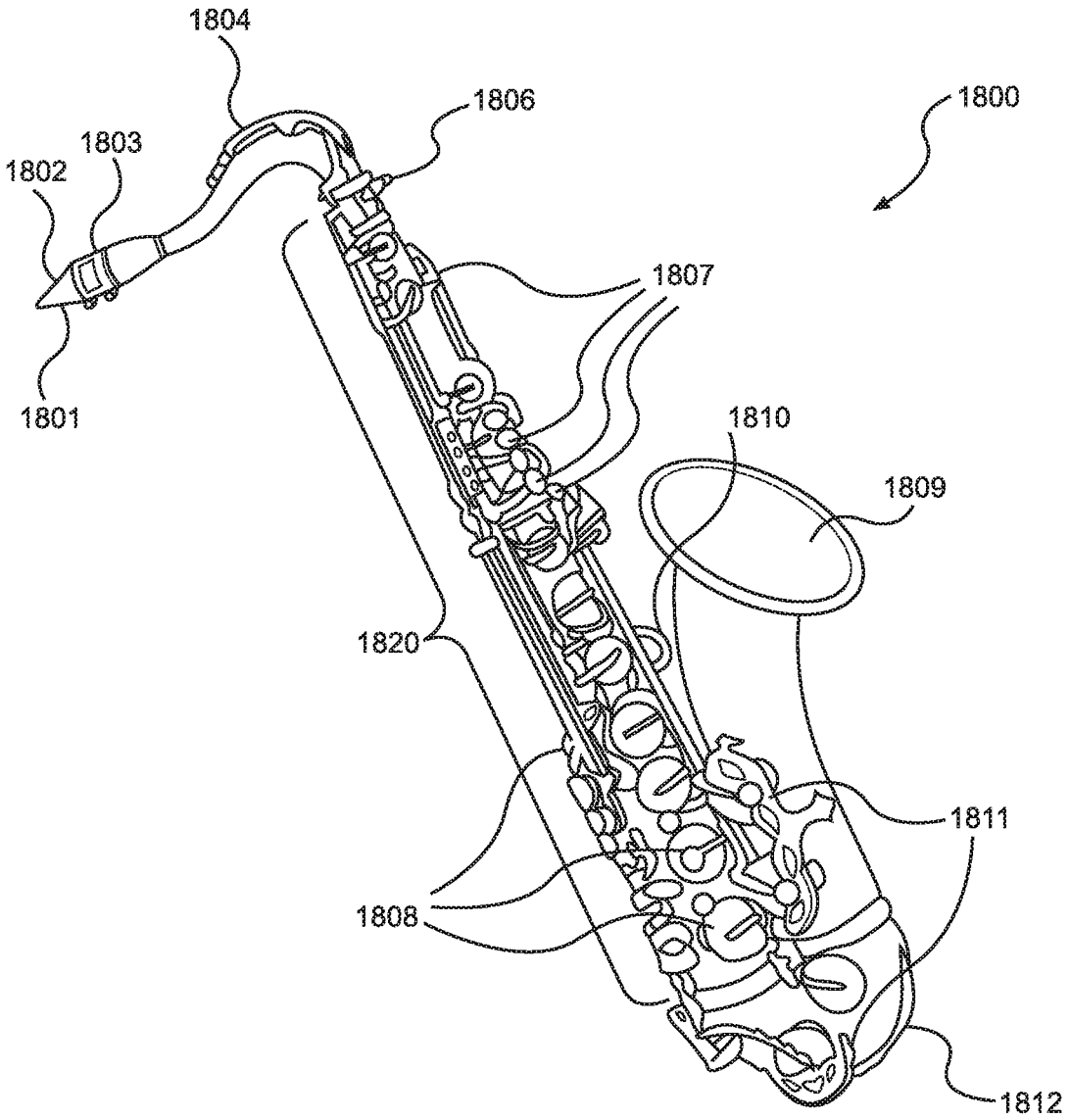

FIG. 17 represents, by profile view, a saxophone which is another example of wind instrument compatible with the system according to the invention.

The saxophone 1800 is made up of the following elements: a reed 1801, a mouthpiece 1802, a ligature 1803, an octave key 1804, a neck 1805, a neck tightening screw 1806, a linked key set 1807 for the left hand, a linked key set 1808 for the right hand, a bell 1809, a bell brace 1810, a key guard 1811 and a breech 1812. The saxophone comprises a tubular body 1820 connected at one end to the neck 1805 and at the other end to the bell 1809.

As for the case of the clarinet, the emitters and receivers of the system according to the invention can be positioned on any part of the saxophone via removable fixing means already described above.

Figure 18:
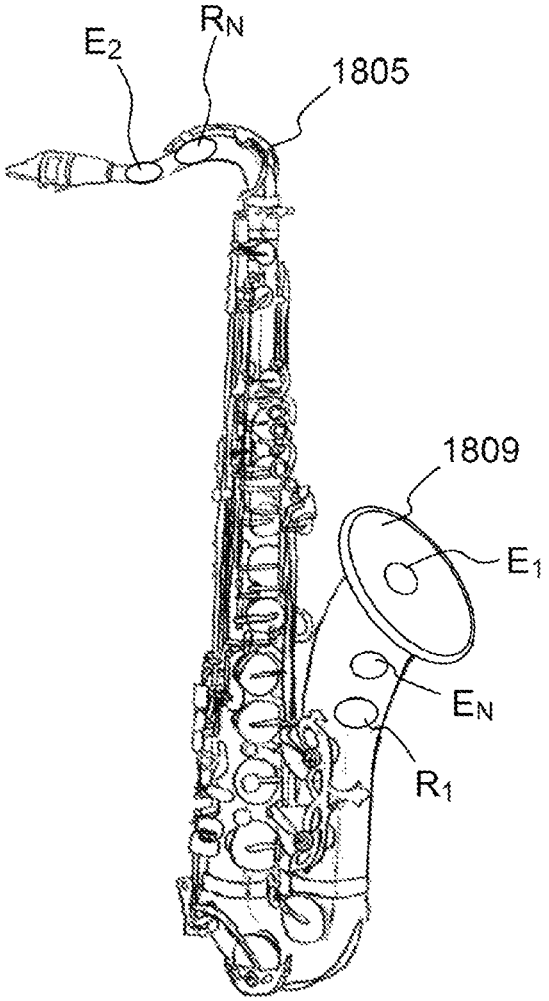

FIG. 18 illustrates an example of positioning of several emitters $E_1,E_2,E_N$ and of several receivers $R_1,R_N$. In this example, the emitters and receivers are preferentially positioned on the neck 1805 or in the bell 1809 but they could also be fixed directly to the body of the instrument. The choice of the number and the placement of the emitters and receivers on the instrument is made so as to be as nonintrusive as possible and the least possible nuisance for the user. The neck and the bell of the saxophone are thus preferred because these parts do not come into interaction with the fingers of the musician.

According to a variant embodiment of the invention, the emitters and receivers of the system according to the invention can also be fixed in a removable part of the saxophone. This removable part can be the neck 1805 which is generally natively removable on a saxophone or the mouthpiece 1802.

The system according to the invention also comprises, as described in support of FIG. 2, a computing device connected to the electrodes of the emitters and receivers of elastic mechanical waves and configured to execute the learning method described in FIG. 4 and the monitoring method described in FIG. 5 with the adaptations described above to adapt these methods to the detection of the state of closing of the holes of the instrument.

The computing device must be removable to allow the instrument to be operated in acoustic mode. To this end, the computing device can be fixed to the instrument through a removable fixing means, for example adhesive, a clamp, a clip, a magnet, a ring, a force-fitting in the air column of the instrument, or any other removable mechanical coupling means. In order not to alter the external visual appearance of the instrument, the computing device can be fixed inside the air column of the instrument, for example inside the body of the instrument or inside another part of the instrument out of the bell, the mouthpiece, the neck or the small barrel.

In the case where the musical instrument is a saxophone, the computing device can be fixed via a casing that can be embedded inside the bell 1809.

In a variant embodiment, the computing device can also be fixed on a removable part of the instrument, as already described for the positioning of the emitters and receivers. In all cases, the choice will be to position the computing device inside the part such that it is situated in the air column of the instrument. The removable part can be one of the following parts: the neck, the bell, the barrel, the small barrel or the mouthpiece of the instrument.

Figure 19:
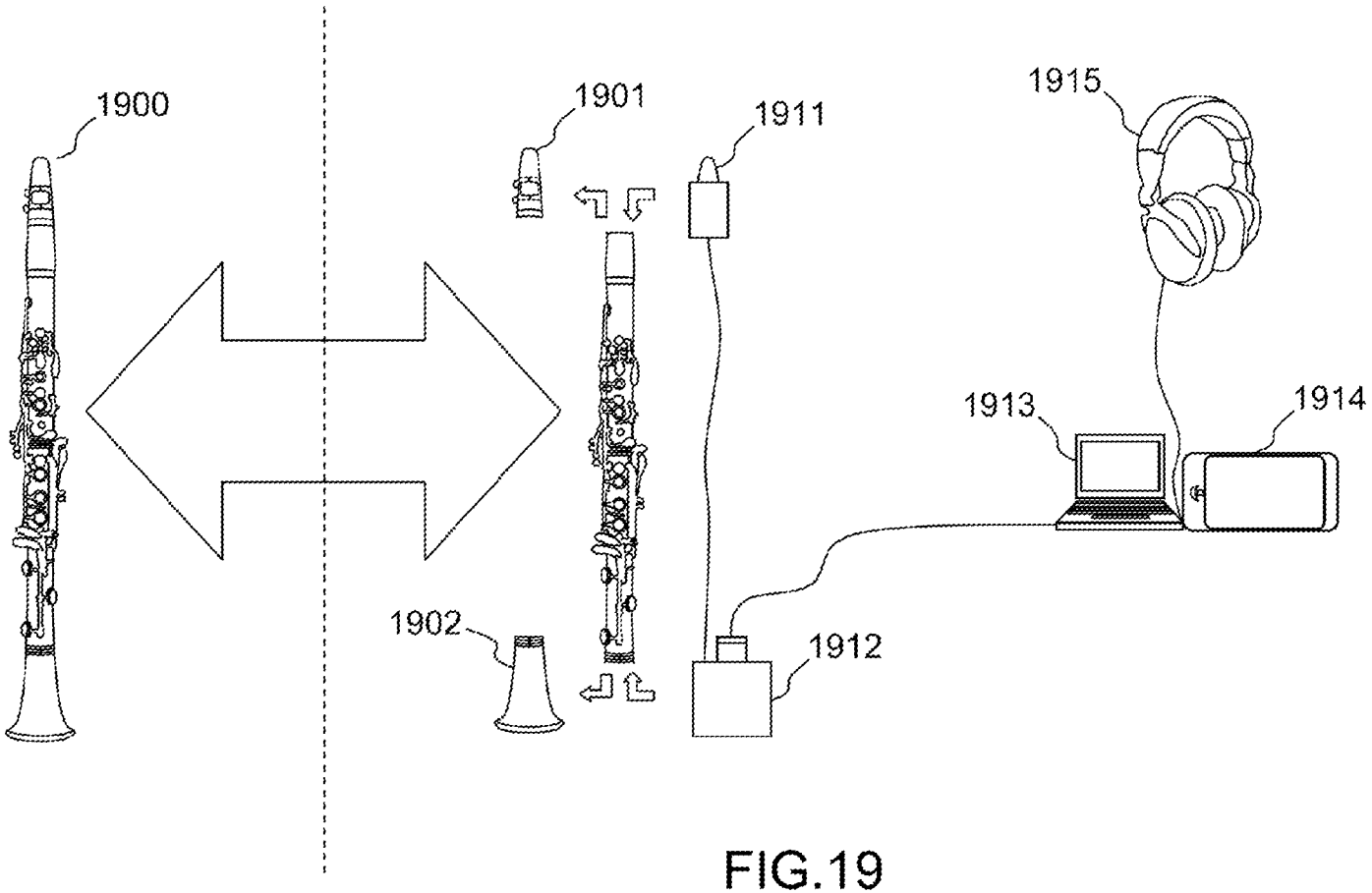

FIG. 19 illustrates, for the case of the clarinet, one possible implementation of the electronic system according to the invention.

The left hand part of FIG. 19 represents a clarinet 1900 in a configuration for an acoustic playing, that is to say an original clarinet.

In the right hand part of FIG. 19, two removable parts of the instrument have been identified: the mouthpiece 1901 and the bell 1902. These two parts can be removed to configure the instrument in digital mode. For that, the original mouthpiece 1901 is replaced by a modified mouthpiece 1911 according to the invention. The modified mouthpiece 1911 can contain, as explained above, some of the emitters and receivers of ultrasound mechanical waves. Similarly, the original bell 1902 can be replaced with a modified bell 1912 according to the invention. The modified bell 1912 can also incorporate one or more emitters of elastic mechanical waves and/or one or more associated receivers. The modified bell 1912 comprises, fixed inside the air column, a computing or electronic device linked to the emitters and receivers to implement the method for detecting and identifying the state of closing of the holes of the instrument.

The modified mouthpiece 1911 can be linked to the computing device incorporated in the modified bell 1912 and comprise a device for detecting the blowing of the player. In this way, it is possible to synchronize the digital playback of the notes with the blowing of the player.

The computing device according to the invention supplies the notes associated with the states of closing of the holes which have been detected to a computer. The computer executes a sound synthesis method to digitally play back the notes to a user by means of a headset 1915. The computer can be embedded in another computer 1913 or a smartphone 1914 or any other equivalent electronic device.

The invention claimed is:

1. An electronic system that can be combined with a wind musical instrument with lateral holes comprising a tubular body defining, on the inside, an air column, said system comprising at least one device for emitting elastic mechanical waves in the body of the instrument, at least one device for receiving elastic mechanical waves positioned to receive the waves emitted by said at least one emission device after their propagation in the material of the body of the instrument and designed to provide at least one reception signal characteristic of the waves received and a device for detecting and locating the disturbance induced by an action of closing at least one lateral hole of the instrument, configured to detect and identify a configuration of closing of the lateral holes of the instrument from the analysis of said at least one reception signal, said detection and location device being positioned removably inside the air column of the instrument.

2. The electronic system of claim 1, comprising a single reception device.

3. The electronic system of claim 1, comprising two reception devices.

4. The electronic system of claim 1, wherein the detection and location device is configured to determine, from the chromatic tablature of the instrument, a musical note associated with the state of closing of the lateral holes of the instrument which has been detected.

5. The electronic system of claim 1, wherein the detection and location device is configured to:

execute a first, learning phase consisting in varying the configurations of the state of closing of the lateral holes of the instrument among all of the possible configurations and record, for each configuration, at least one reference characteristic of said at least one reception signal, execute a second, monitoring phase while a user plays said musical instrument consisting in recording, for each note played by the user, at least one current characteristic of said at least one reception signal equivalent to said reference characteristic, and comparing the current characteristic to all of the recorded reference characteristics to deduce therefrom the configuration of closing of the holes of the instrument actuated by the player.

6. The electronic system of claim 1 comprising, for each device for emitting elastic mechanical waves and each device for receiving elastic mechanical waves, a means for removably fixing the device to the body of the wind musical instrument.

7. The electronic system of claim 6, wherein the removable fixing means is taken from the following means: adhesive, a clamp, a clip, a magnet, a ring.

8. The electronic system of claim 1, wherein said at least one device for emitting elastic mechanical waves and said at least one device for receiving elastic mechanical waves are positioned in a removable part of the wind musical instrument.

9. The electronic system of claim 8, wherein the removable part of the instrument is taken from the following removable parts of the instrument: the neck, the bell, the barrel, the small barrel, the mouthpiece.

10. The electronic system of claim 1, comprising a means for removably fixing said detection and location device inside the air column of the wind musical instrument.

11. The electronic system of claim 1, wherein said detection and location device is positioned in a removable part of the wind musical instrument of which the inside is partly hollow in order to define an air column, said detection and location device being positioned inside the air column.

12. The electronic system of claim 1, wherein a device for emitting elastic mechanical waves is a piezoelectric actuator and a device for receiving elastic mechanical waves after their propagation is a piezoelectric receiver.

13. The electronic system of claim 1, also comprising a sound synthesis device connected to the detection and location device for playing back to a user the notes associated with the detected configurations of closing of the holes of the musical instrument as a function of the chromatic tablature of the musical instrument.

14. A wind musical instrument with lateral holes intended to selectively produce acoustic sounds and electrical sounds, comprising a wind musical instrument with lateral holes combined with an electronic system comprising at least one device for emitting elastic mechanical waves in the body of the instrument, at least one device for receiving elastic mechanical waves positioned to receive the waves emitted by said at least one emission device after their propagation in the material of the body of the instrument and designed to provide at least one reception signal characteristic of the waves received and a device for detecting and locating the disturbance induced by an action of closing at least one lateral hole of the instrument, configured to detect and identify a configuration of closing of the lateral holes of the instrument from the analysis of said at least one reception signal, said detection and location device being positioned removably inside the air column of the instrument.

15. The wind musical instrument with lateral holes of claim 14, wherein said instrument is a saxophone or a clarinet or a flute or an oboe or a bassoon.

* * * * *